United States Patent [19]

Hatas et al.

[11] Patent Number: 4,769,954

[45] Date of Patent: Sep. 13, 1988

[54] APPARATUS FOR SUPPORTING AND GRINDING AN EDGE OF A PLANAR GLASS WORKPIECE

[75] Inventors: Peter J. Hatas, Toledo; Randy W. Croson, Liberty Center, both of Ohio

[73] Assignee: Royal Tool, Inc., Toledo, Ohio

[21] Appl. No.: 62,144

[22] Filed: Jun. 15, 1987

[51] Int. Cl.[4] ..... B24B 51/00

[52] U.S. Cl. ..... 51/165.71; 51/105 LG; 51/215 R; 198/345; 198/379; 198/394

[58] Field of Search ..... 51/165.71, 101 LG, 105 LG, 51/106 LG, 215 R, 215 CP, 216 LP; 198/345, 379, 394

[56] References Cited

U.S. PATENT DOCUMENTS

| | | | |
|---|---|---|---|
| 2,515,548 | 7/1950 | Brogren et al. | 164/48 |
| 2,531,640 | 11/1950 | Oberstar | 198/33 |
| 3,182,815 | 5/1965 | Di Lella et al. | 214/1 |
| 3,276,565 | 10/1966 | Oman | 198/33 |
| 3,358,852 | 12/1967 | Fegley | 198/379 X |
| 3,390,974 | 7/1968 | Parsons et al. | 65/323 |
| 3,400,835 | 9/1968 | Rhoads | 214/1 |
| 3,589,078 | 6/1971 | Bala et al. | 51/165.77 |
| 3,595,370 | 7/1971 | Fujishiro | 198/379 X |
| 3,932,962 | 1/1976 | Devillers | 51/165.72 |
| 4,270,651 | 6/1981 | Ragard et al. | 198/345 X |
| 4,360,313 | 11/1982 | Satzler | 414/781 |
| 4,380,939 | 4/1983 | Gardner | 198/345 X |
| 4,423,569 | 1/1984 | Stern et al. | 51/101 LG |
| 4,425,075 | 1/1984 | Quinn | 414/755 |
| 4,426,811 | 1/1984 | Eckardt et al. | 51/215 R X |
| 4,466,768 | 8/1984 | Datseris et al. | 414/729 |
| 4,638,609 | 1/1987 | Steere et al. | 51/165.71 |

FOREIGN PATENT DOCUMENTS

| | | | |
|---|---|---|---|
| 1924315 | 7/1971 | Fed. Rep. of Germany | 51/215 R |
| 3301200 | 7/1983 | Fed. Rep. of Germany LG | 51/101 |
| 3,422,538 | 1/1986 | Fed. Rep. of Germany LG | 51/101 |
| 0005283 | 1/1980 | Japan | 198/345 |

*Primary Examiner*—Frederick R. Schmidt
*Assistant Examiner*—Shirish Desai
*Attorney, Agent, or Firm*—MacMillan, Sobanski & Todd

[57] ABSTRACT

An improved structure for supporting and positioning a planar glass workpiece within a glass grinding apparatus is disclosed. Three radially extending carriage assemblies are provided between a lower pan and an upper supporting platform. Each of the carriage assemblies extends radially outwardly from a central drive shaft connected to the supporting platform to the periphery of the lower pan. The radial inner ends of the carriage assemblies are rotatably supported about the drive shaft, while the radial outer ends are carried on respective motor assemblies connected to a gear formed on a lower pan. Energization of the motor assemblies causes the associated carriage assemblies to pivot relative to the lower pan. Each of the carriage assemblies also carries a locator cylinder assembly thereon. The locator cylinder assemblies are movable radially inwardly and outwardly throughout the length of the corresponding carriage assemblies by means of the associated motor assemblies. Each of the locator cylinder assemblies includes a locator button assembly. Each of the locator button assemblies is selectively movable between an extended position and a retracted position. A computer controls the operation of all of the motor assemblies so as to angularly position each of the carriage assemblies and to radially position each of the locator cylinder assemblies, all in accordance with predetermined stored data relating to the particular shape of the glass workpiece.

25 Claims, 6 Drawing Sheets

APPARATUS FOR SUPPORTING AND GRINDING AN EDGE OF A PLANAR GLASS WORKPIECE

BACKGROUND OF THE INVENTION

The present invention relates in general to glass grinding machines and in particular to an apparatus for supporting and positioning a planar glass workpiece so as to permit the outer peripheral edge thereof to be ground in accordance with a predetermined pattern.

In the manufacture of certain glass articles, such as vehicle windshields and the like, a planar glass workpiece is initially formed and cut in a shape which closely approximates the ultimate shape of the final article. Following such initial formation, a grinding operation is usually performed on the outer peripheral edge of the workpiece in order to insure that the dimensions thereof conform to predetermined tolerances. The grinding operation causes a small amount of glass to be removed from the outer peripheral edge of the workpiece in order to precisely define the shape of its perimeter. Since the workpiece is frequently incorporated into an assembly in which the outer peripheral edge cooperates with a fluid tight seal, it is very important that the dimensions thereof be formed closely in accordance with the predetermined tolerances.

In order to accomplish this grinding operation, a grinding apparatus has been utilized in the past to support and position the glass workpiece, as well as to grind the outer peripheral edge thereof. Such a grinding apparatus included a supporting platform having one or more locators movably connected thereto. The locators were initially positioned manually in a predetermined position relative to the supporting platform by means of a template or other mechanical device. The positions of the locators defined points which, when abutted by the outer peripheral edge of the glass workpiece, properly positioned such workpiece relative to the supporting platform. Once the locators were properly positioned, the glass workpiece was laid upon the top of the supporting platform and manually pushed in sliding fashion until its outer peripheral edge abutted each of the locators. Then, the workpiece was clamped to the table, and the locators were retracted to non-engaging positions. The table was next rotated relative to an edge grinder, which was also movably connected to the supporting platform. As the edge of the workpiece moved by the edge grinder, material was removed therefrom in accordance with predetermined pattern.

The manual positioning of the locators was a slow and inefficient process in the initial set up of the grinding apparatus. Such inefficiencies were compounded if the grinding apparatus was utilized to grind the edges of a number of differently sized workpieces. Each differently sized glass workpiece required the locators to be manually repositioned. Accordingly, it would be desirable to provide a grinding apparatus which permits the locators to be automatically repositioned in a quick and easy manner for differently sized glass workpieces. At the same time, such a grinding apparatus must also be able to perform the grinding operation rapidly and accurately, thus requiring the planar glass workpieces to be consistently and accurately positioned at the same relative location within the glass grinding apparatus.

SUMMARY OF THE INVENTION

The present invention relates to an improved means for supporting and positioning a planar glass workpiece within a glass grinding apparatus to permit the edge thereof to be ground rapidly and accurately in accordance with a predetermined pattern. The glass grinding apparatus includes a supporting platform upon which the workpiece is laid prior to positioning. The supporting platform is carried on a drive shaft which is rotatably journalled above the center of a circular lower pan. The lower pan has a circumferential gear formed about the periphery thereof. Three radially extending carriage assemblies are provided between the table and the supporting platform. Each of the carriage assemblies extends radially outwardly from the drive shaft to the periphery of the table. The radial inner ends of the carriage assemblies are rotatably supported about the drive shaft, while the radial outer ends are carried on respective motor assemblies connected to the gear formed on the lower pan. Energization of the motor assembly causes the associated carriage assembly to pivot about the supporting platform relative to the lower pan.

Each of the carriage assemblies also carries a locator cylinder assembly thereon. The locator cylinder assemblies are movable radially inwardly and outwardly throughout the length of the corresponding carriage assemblies by means of the associated motor assemblies. Each of the locator cylinder assemblies include a locator button. Each of the locator buttons is selectively movable between an extended position, wherein it is disposed in a position for engagement by the outer peripheral edge of the glass workpiece during the positioning process, and a retracted position, wherein it is disposed in a position where it cannot be engaged by the workpiece. Each of the locator buttons includes a sensor adapted to generate a signal when it is engaged by the outer peripheral edge of the workpiece. The sensors are constructed such that signals are generated regardless of where the workpiece abuts the associated locator button. A computer controls the operation of all of the motor assemblies so as to angularly position each of the carriage assemblies and to radially position each of the locator cylinder assemblies, all in accordance with predetermined stored data relating to the particular shape of the glass workpiece. The computer also receives the signals from each of the sensors in order to determine when the workpiece is properly positioned within the glass grinding apparatus.

It is an object of the present invention to provide a glass grinding apparatus which rapidly and accurately positions a planar glass workpiece therein to permit an edge grinding operation to occur.

It is another object of the present invention to provide such a positioning means which is easily changeable from one glass grinding pattern to another.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
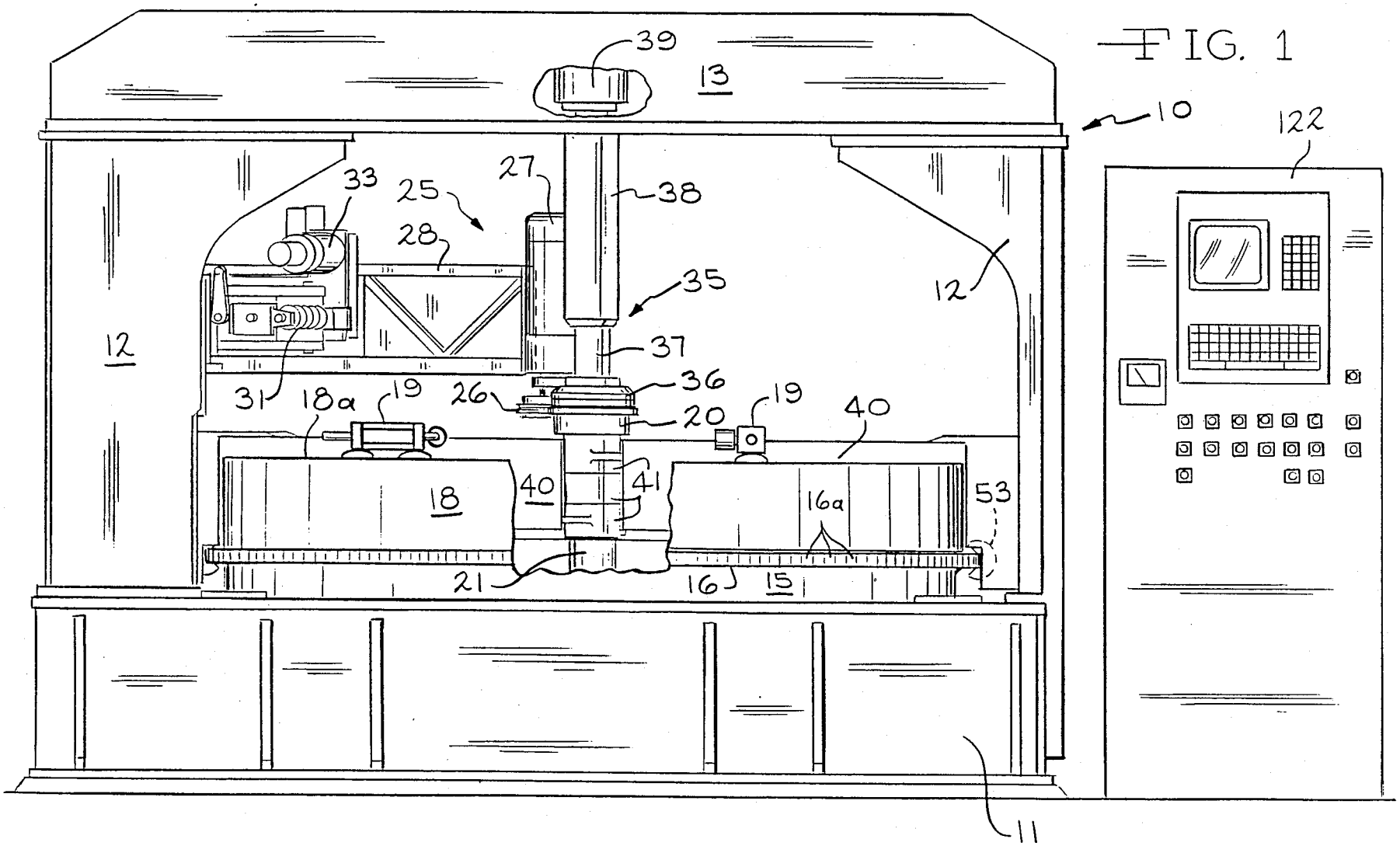
FIG. 1 is a front elevational view, partially broken away, of a glass grinding apparatus and computer in accordance with the present invention.
Figure 2:
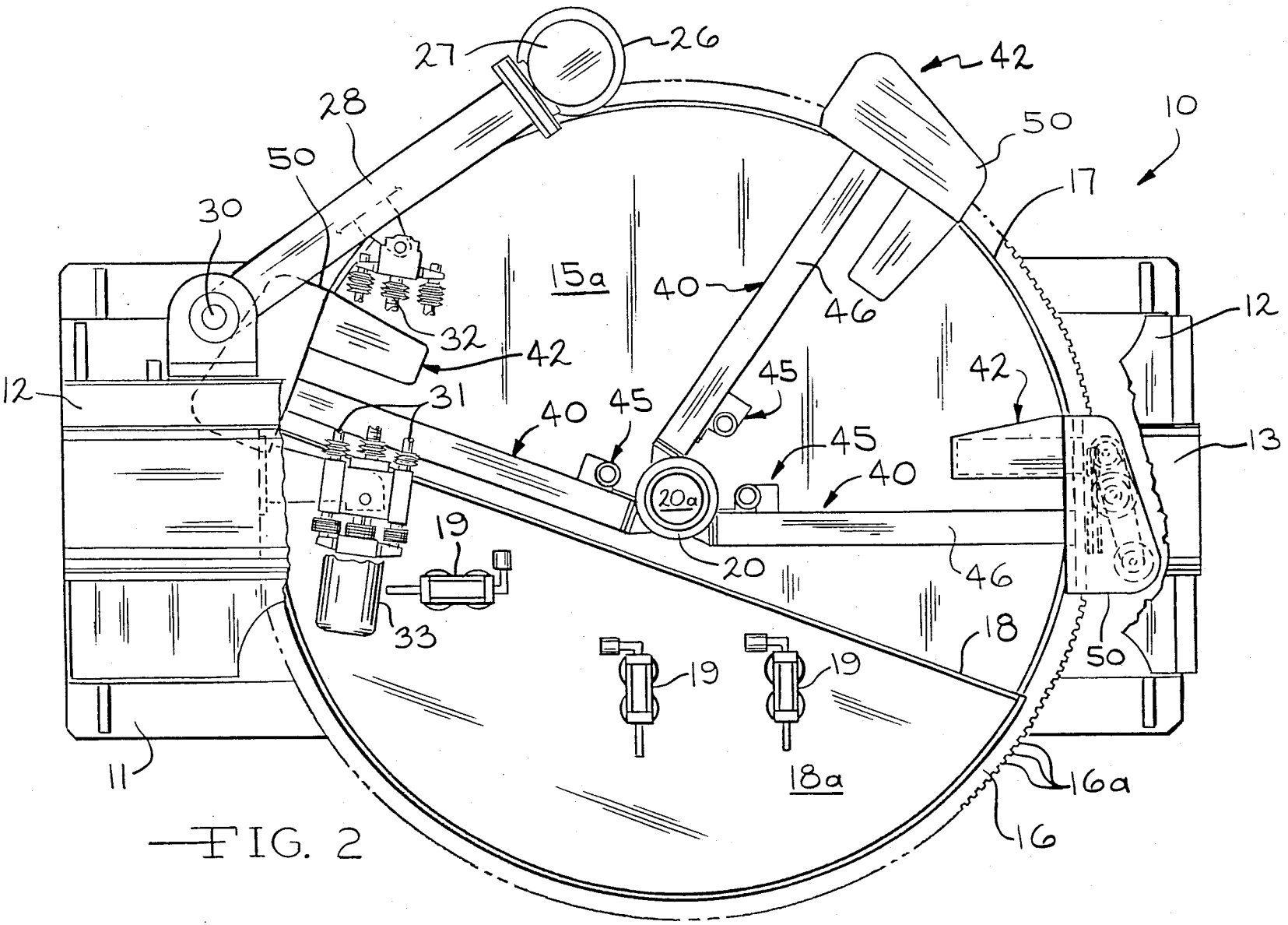
FIG. 2 is a top plan view, partially broken away, of the glass grinding apparatus illustrated in FIG. 1.

Referring now to the drawings, there is illustrated in FIGS. 1 and 2 a glass grinding apparatus, indicated generally at 10, in accordance with the present invention. The glass grinding apparatus 10 includes a base 11, a pair of columns 12 extending upwardly from the opposite sides of the base 11, and an upper bridge 13 extending between the upstanding columns 12 above the base 11. A generally cylindrical lower pan 15 having an upper surface 15*a* is supported by the base 11. Around the outer circumference of the lower pan 15, a gear 16 is formed having radially outwardly extending teeth 16*a*. The gear 16 can be formed integrally with the lower pan 15 or can be secured thereto by any conventional means, such as by welding. The central portion of the upper surface 15*a* of the lower pan 15 is recessed downwardly below the outer peripheral edge thereof, thereby defining an annular flange 17 extending about the perimeter of the upper surface 15*a*. A generally semi-cylindrical upper pan 18 fits over a portion of the lower pan 15 and the flange 17. The upper end of the upper pan 18 is closed by a flat upper surface 18*a*, while the lower end of the upper pan 18 is open and rests upon the upper face of the gear 16. A plurality of stationary relocators 19 are provided on the upper surface 18*a* of the upper pan 18. The structure and operation of the stationary relocators 19 will be explained in detail below.

A generally cylindrical supporting platform 20 is provided above the center of the lower pan 15 and above the upper surface 18*a* of the upper pan 18. The supporting platform 20 has a flat upper surface 20*a* and is secured to the upper end of a drive shaft 21. The drive shaft 21 is connected through a gear box to a motor (neither shown) disposed within the base 11. The drive shaft 21, the gear box, and the motor form a means for rotating the supporting platform 20 relative to the rest of the glass grinding apparatus 10. As will be explained in detail below, the supporting platform 20 is adapted to support a planar glass workpiece on the upper surface 20*a* thereof, while the drive shaft 21, the gear box, and the motor are adapted to rotate the supported workpiece relative to the glass grinding apparatus 10.

A grinding spindle assembly, indicated generally at 25, is pivotally connected to one of the upstanding columns 12 of the glass grinding apparatus 10. The grinding spindle assembly 25 includes a conventional grinding wheel 26 connected to a motor 27. The motor 27 is adapted to rotate the grinding wheel 26 in a known fashion so as to cause the grinding wheel 26 to remove material from an edge of a planar glass workpiece (see FIGS. 8 through 10) supported upon the upper surface 20*a* of the platform 20. The grinding wheel 26 and the motor 27 are carried by a pivot arm 28, which is connected to the upstanding column 12 at a pivot point 30. Means are provided for pivoting the grinding spindle assembly 25 between an extended position, wherein the grinding wheel 26 is moved toward the supporting platform 20 (as illustrated in FIG. 1), and a retracted position, wherein the grinding wheel 26 is moved away from the supporting platform 20 (as illustrated in FIG. 2). Such means includes a pair of guide rods 31 and a ball screw shaft 32. The ball screw shaft 32 cooperates with a ball screw nut (not shown) which is selectively rotated by a servo motor 33. When the servo motor 33 rotates the ball screw nut, the ball screw shaft 32 is moved longitudinally relative thereto. The servo motor 33 is bi-directional, thus permitting the ball screw shaft 32 to be moved selectively in opposite longitudinal directions. Consequently, the pivot arm 28, the edge grinder motor 27, and the grinding wheel 26 may all be pivoted relative to the glass grinding apparatus 10 between the extended and retracted positions. The operation of the servo motor 33 is controlled in a manner which is described in detail below.

Figure 9:
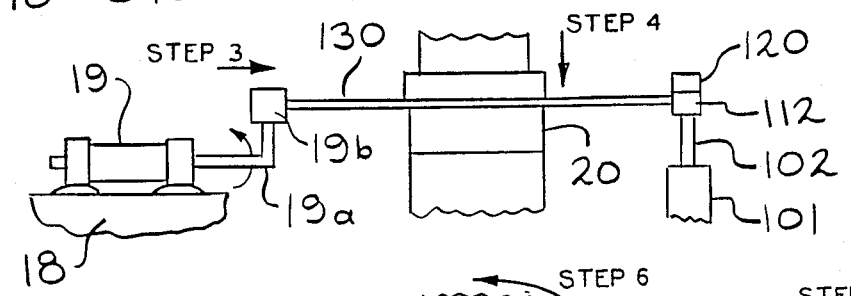

A clamping assembly, indicated generally at 35, is connected to the upper bridge 13 of the glass grinding apparatus 10. The clamping assembly 35 is disposed above the supporting platform 20 and includes a clamp member 36 connected to a clamp shaft 37. The clamp shaft 37 is journalled for reciprocating longitudinal movement in a housing 38 secured to the upper bridge 13. Means are provided for selectively moving the clamp member 36 and the clamp shaft 27 between a clamped position, wherein the clamp member 36 is moved downwardly into abutting engagement with a planar glass workpiece laying on the upper surface 20*a* of the supporting platform 20 (as illustrated in FIG. 9), and a retracted position, wherein the clamp member 36 is moved upwardly out of such abutting engagement. A compressed air actuator 39 or similar means is disposed in the upper bridge 13 and is connected to the piston rod 37 for selectively causing such longitudinal movement. The operation of the compressed air actuator 39 is controlled in a manner which is also described in detail below.

Figure 5:
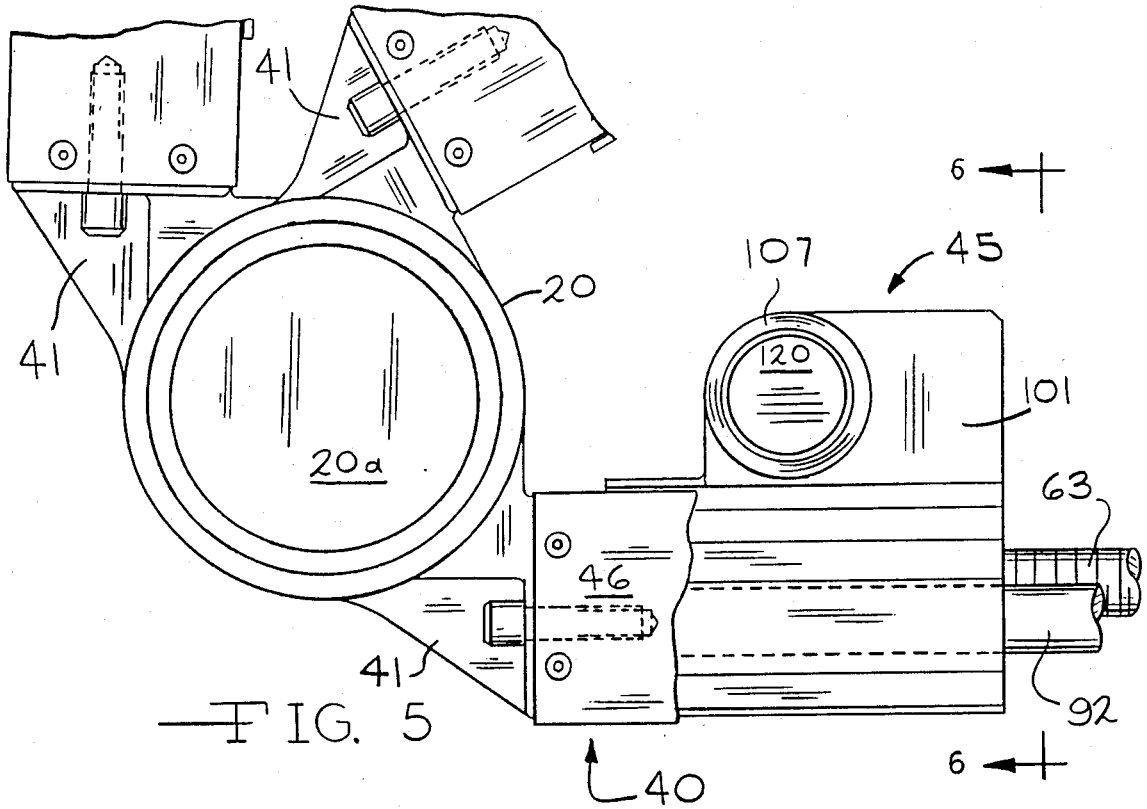
FIG. 5 is a fragmentary top plan view of the supporting platform and the locator cylinder assemblies illustrated in FIG. 1.

As best illustrated in FIG. 2, a plurality of carriage assemblies, indicated generally at 40, are provided about the lower pan 15. The carriage assemblies 40 extend generally radially outwardly from the supporting table 20 and the drive shaft 21 to the outer edge of the gear 16. Referring to FIGS. 1 and 5, it can be seen that the radial inner end of each of the carriage assemblies 40 is rotatably mounted about the drive shaft 21 by a respective knuckle 41. The knuckles 41 are arranged in vertically adjacent co-axial relationship about the drive shaft 21 between the supporting platform 20 and the lower pan 15. Respective bearings (not shown) are provided between each of the knuckles 41 and the drive shaft 21 so as to permit the knuckles 41 to rotate relative thereto. At the radial outer end of each of the carriage assemblies 40, a motor assembly 42 is provided. As will be explained in detail below, each of the motor assemblies 42 cooperates with the gear 16 in order to support its associated carriage assembly 40 and to selectively pivot such carriage assembly 40 about the drive shaft 21 relative to the lower pan 15. Although the carriage assemblies 40 are illustrated as being rotatable relative to the lower pan 15, it will be appreciated that a greater or lesser number of carriage assemblies 40 may be provided, and that one or more of such carriage assemblies 40 may be fixed in position relative to the lower pan 15 and, therefore, not pivotable.

A locator cylinder assembly, indicated generally at 45, is carried on each of the carriage assemblies 40. As will also be explained in detail below, each of the locator cylinder assemblies 45 is selectively movable radially inwardly and outwardly along its associated carriage assembly 40. A protective shroud 46 is provided about each of the carriage assemblies 40. Each shroud 46 covers the internal components of its carriage assembly 40 so as to prevent foreign materials from entering therein. The shrouds 46 do not prevent the locator cylinder assemblies 45 from moving radially inwardly and outwardly during use.

Figure 3:
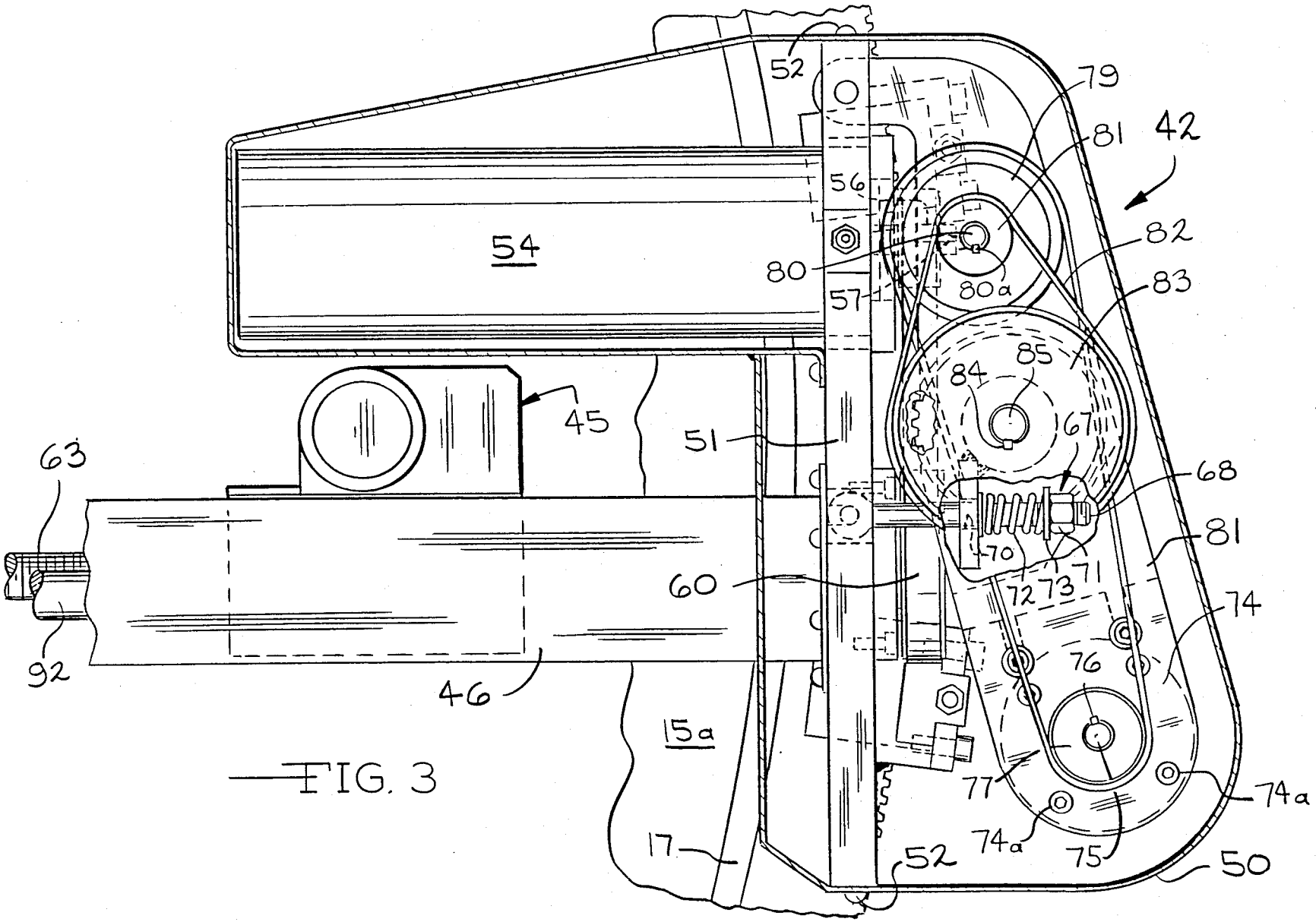
FIG. 3 is a fragmentary top plan view, partially broken away, of one of the carriage motor assemblies and locator cylinder assemblies illustrated in FIG. 1.
Figure 4:
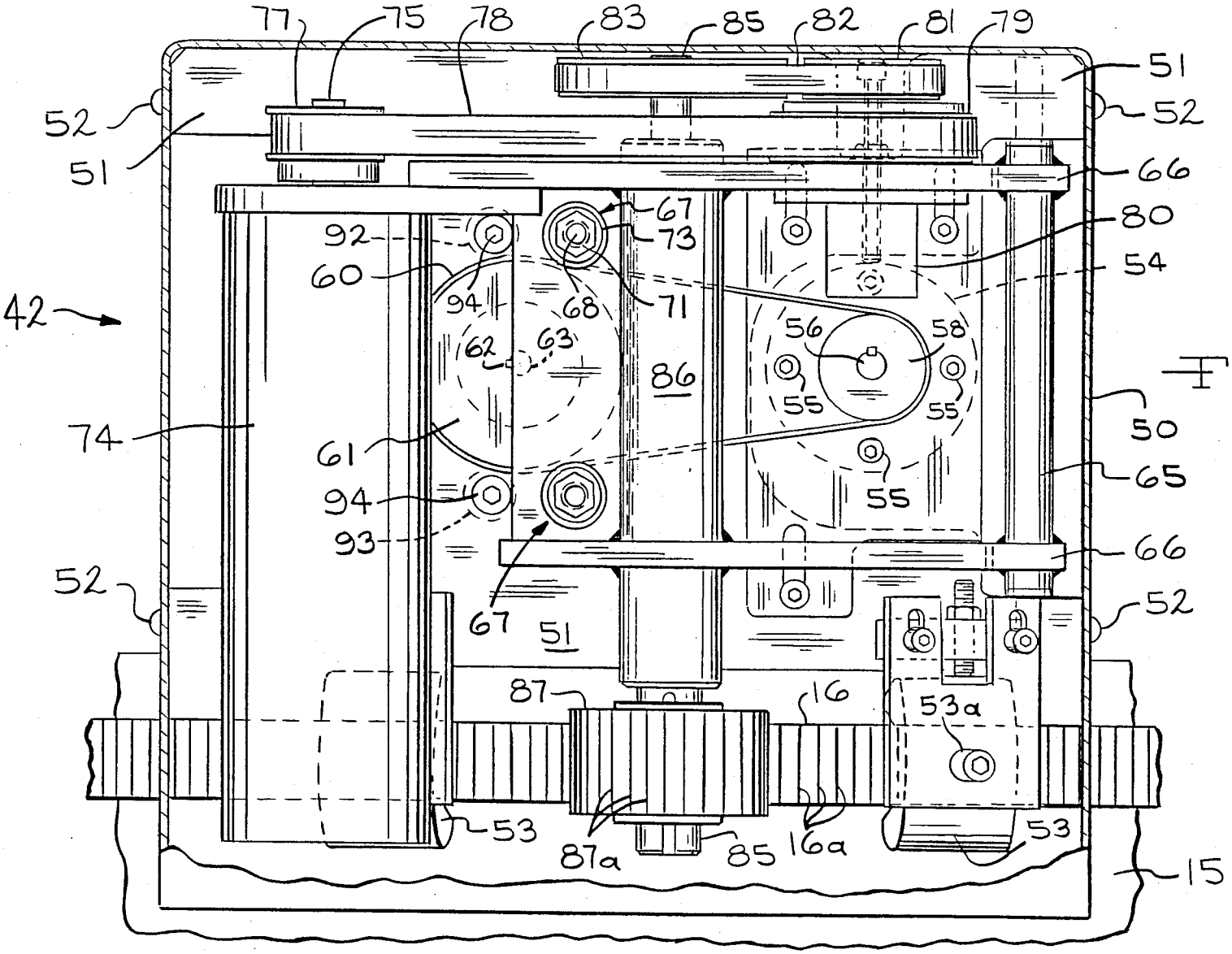
FIG. 4 is a fragmentary end elevational view of the carriage motor assembly illustrated in FIG. 3.

Referring now to FIGS. 3 and 4, one of the motor assemblies 42 is illustrated in detail. As shown therein, a protective cover 50 is provided about the motor assembly 42 so as to enclose the components therein. The cover 50 is removably secured to a frame 51 of the motor assembly 42 by means of a plurality of threaded fasteners 52. The frame 51 is connected to the outer end of the associated radially extending carriage assembly 40 by a plurality of threaded fasteners (not shown). The frame 51 is supported on the gear 16 by a pair of generally C-shaped linear bearings 53. The C-shaped linear bearings 53 are themselves secured to the frame 51 by means of one or more threaded fasteners 53*a* (only one is illustrated). As best shown in FIGS. 1 and 4, the open side of each of the C-shaped linear bearings 53 is adapted to receive the radial outer portion of the gear 16 therein. The C-shaped linear bearings 53 do not engage the teeth 16*a* of the gear 16, but rather abut the flat upper and lower faces thereof. As a result, the frame 51 is supported for sliding movement along on the gear 16. The C-shaped linear bearings 53 are preferably formed from a synthetic material which is resistant to wear, yet which provides a relatively low amount of friction when engaged with the gear 16. If desired, a lubricating fluid (not shown) may be provided between the C-shaped linear bearings 53 and the gear 16 to further reduce the effects of friction.

A first servo motor 54 is mounted on the frame 51 by means of a plurality of threaded fasteners 55. The first servo motor 54 includes an output shaft 56 which is adapted to be rotated when the first servo motor 54 is activated. The output shaft 56 is connected by means of a key 57 to a first pulley 58. The first servo motor 54 is oriented within the motor assembly 42 such that the axis of rotation of the output shaft 56 (and the first pulley 58 connected thereto) is generally parallel with the radially extending carriage assembly 40. A first drive belt 60 provides a driving connection between the first pulley 58 and a second pulley 61. The second pulley 61 is rotatably secured to the frame 51 and is connected by means of a key 62 to a rotatable locator shaft 63. The locator shaft 63 has a helical ball screw worm gear formed on its exterior surface. The locator shaft 63 extends radially inwardly through the carriage assembly 40. The radial inner end of the locator shaft 63 is journalled for rotation in a bearing (not shown) secured to the corresponding knuckle 41 beneath the supporting platform 20. Thus, it can be seen that the ball screw warm gear of the locator shaft 63 is rotated when the first servo motor 54 is activated. The first servo motor 54 is bi-directional, permitting the locator shaft 63 to be rotated in either a clockwise or counter-clockwise direction, when viewing FIG. 4.

On the right side of FIG. 4, a pivot housing 65 is provided having an upper end and a lower end, each of which are journalled in the frame 51 for pivotable motion relative thereto. A pivot bracket 66 is secured to the pivot housing 65 by any conventional means, such as by welding. Thus, the pivot housing 65 and the pivot bracket 66 are pivotable relative to the frame 51. A pair of spring loaded retainer assemblies, indicated generally at 67, are provided to urge the pivoting end of the pivot bracket 66 toward the frame 51 to militate against such pivoting movement. As best shown in FIG. 3, each of the retainer assemblies 67 includes a retainer shaft 68 secured to the frame 51 and extending radially outwardly therefrom. The retainer shaft 68 extends through an aperture 70 formed through the pivot bracket 66. The end of the retainer shaft 68 is threaded, and a nut 71 is threaded thereon. Between the nut 71 and the pivot bracket 66, a coil spring 72 is disposed about the retainer shaft 68. A washer 73 can also be disposed about the retainer shaft 68 in order to prevent the end of the spring 72 from slipping over the nut 71. Inasmuch as the positions of the retainer shaft 68, the nut 71, and the washer 73 are fixed relative to the frame 51, the force generated by the springs 72 causes the pivot bracket 66 to be pivoted inwardly toward the frame 51. However, it will be appreciated that the nuts 71 may be removed in order to permit the mounting bracket 66 to be pivoted outwardly away from the frame 51.

A second servo motor 74 is mounted on the frame 51 by means of a plurality of threaded fasteners 74*a*. The second servo motor 54 includes an output shaft 75 which is adapted to be rotated when the second motor 74 is activated. The output shaft 75 is connected by means of a key 76 to a third pulley 77. The second motor 74 is oriented within the motor assembly 42 such that the axis of rotation of the output shaft 75 (and the third pulley 77 connected thereto) is generally perpendicular to the radially extending carriage assembly 40. A second drive belt 78 provides a driving connection between the third pulley 77 and a fourth pulley 79. The fourth pulley 79 is connected to a jack shaft 80 for rotation therewith by means of a key 80*a*. The jack shaft 80 is journalled to the pivot bracket 66 for rotation relative thereto. A fifth pulley 81 is also connected to the jack shaft 80 for rotation therewith by means of the key 80*a*.

A third drive belt 82 provides a driving connection between the fifth pulley 81 and a sixth pulley 83. The sixth pulley 83 is connected by means of a key 84 to a rotatable carriage shaft 85. The carriage shaft 85 extends downwardly through a journal 86 secured to the pivot bracket 66 by any conventional means, such as by welding. The lower end of the carriage shaft 85 is connected for rotation with a carriage gear 87. The carriage gear 87 includes a plurality of teeth 87*a* which cooperate with the teeth 16*a* formed on the gear 16. When the second servo motor 74 is activated, the carriage gear 87 is rotated. Because of the engagement of the carriage gear teeth 87*a* with the gear teeth 16*a*, and further because the radially inner end of the carriage 40 is rotatably secured to the drive shaft 21, activation of the second servo motor 74 causes the carriage assembly 40 to pivot about the drive shaft 21 relative to the lower pan 15, similar to a door swinging about a hinge disposed co-axially with respect to the drive shaft 21. The second servo motor 74 is bi-directional, thus permitting the carriage shaft 85 to rotate in either a clockwise or counter-clockwise direction, when viewing FIG. 3. Consequently, the carriage assembly 40 is pivoted in either a clockwise or counter-clockwise direction relative to the lower pan, when viewing FIGS. 2 and 5.

Figure 6:
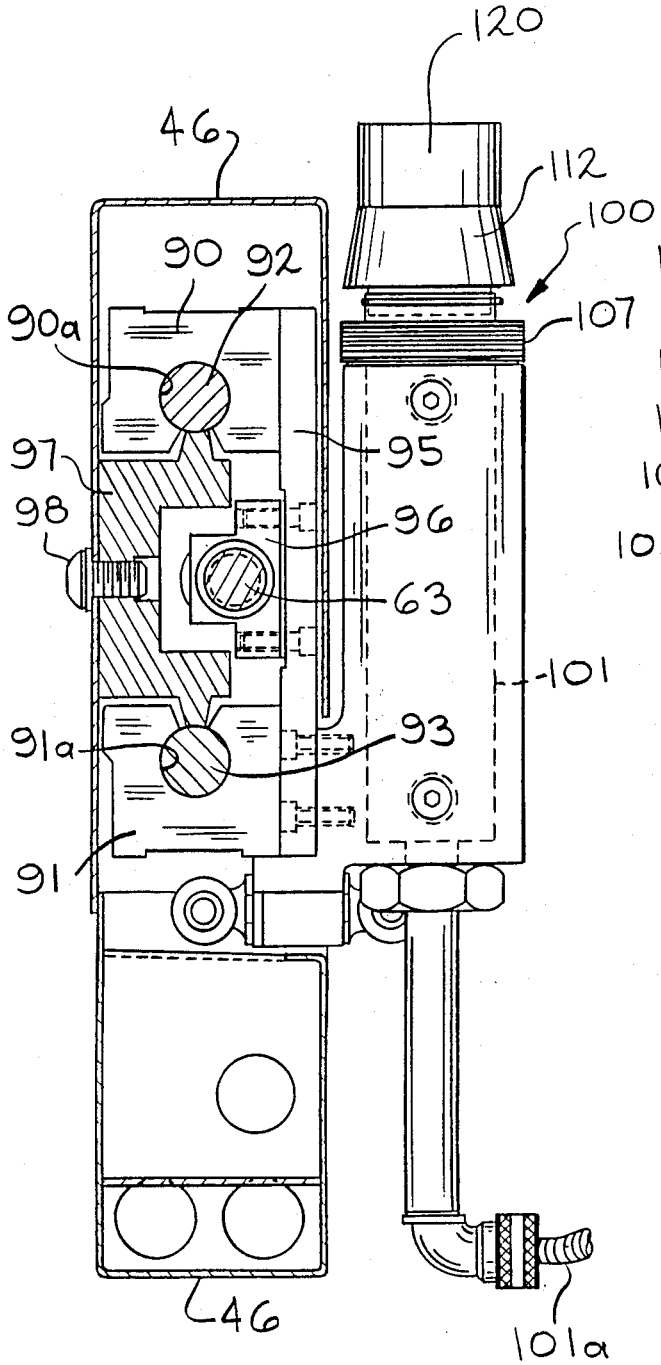
FIG. 6 is a sectional elevational view of one of the locator cylinder assemblies taken along line 6—6 of FIG. 5.

Referring now to FIG. 6, one of the locator cylinder assemblies 45 is illustrated in detail. As shown therein, the locator cylinder assembly 45 includes an upper bearing member 90 and a lower bearing member 91. The upper and lower bearing members 90 and 91 have respective cylindrical grooves 90*a* and 91*a* formed therethrough adapted to receive upper and lower guide shafts 92 and 93. The radial outer ends of the guide shafts 92 and 93 are secured to the frame 51 of the motor assembly 42 by respective threaded fasteners 94. The radial inner ends of the guide shafts 92 and 93 are secured to the knuckles 41 in a similar manner. The upper and lower bearing members 90 and 91 are supported on the respective guide shafts 92 and 93 so as to be movable radially inwardly and outwardly along the guide shafts 92 and 93.

The upper and lower bearing members 90 and 91 are connected together by a bracket 95, which may be formed integrally with the upper and lower bearing members 90 and 91. A ball nut 96 is also connected to the bracket 95. The ball nut 96 has a cylindrical aperture formed therethrough which is internally threaded so as to cooperate with the external helical ball screw worm gear formed on the locator shaft 63. Since the ball nut 96 is secured to the bracket 95, it can be seen that rotation of the locator shaft 63 as described above causes the entire locator cylinder assembly 45 to move radially inwardly or outwardly along the guide shafts 92 and 93, depending upon the direction of rotation of the locator shaft 63. A mounting frame 97 is provided between the guide shafts 92 and 93. The shroud 46 is connected to the mounting frame 97 by means of a threaded fastener 98. The lower portion of the shroud 46 includes several passageways which permit various compressed air, electric, or other lines (not shown) to be passed therethrough.

Figure 7:
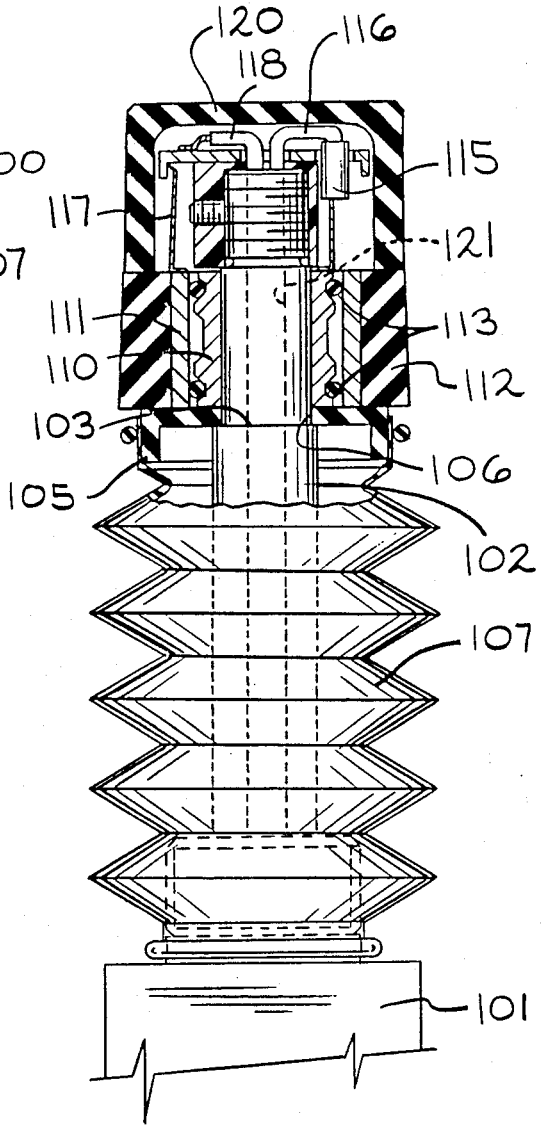
FIG. 7 is an enlarged fragmentary elevational view, partially in cross section, of the locator button assembly illustrated in FIGS. 5 and 6.

Referring now to FIG. 7, a locator button assembly, indicated generally at 100, is illustrated as also being connected to the bracket 95. The locator button assembly 100 includes an air actuated cylinder 101 having a cylindrical piston rod 102 extending upwardly therefrom. When air pressure is supplied to the air cylinder 101 through a conduit 101*a*, the piston rod 102 is axially retracted downwardly from the extended position illustrated in FIG. 7 to the retracted position illustrated in FIG. 6. When such air pressure is removed, the piston rod 102 is axially extended upwardly within the air cylinder 101. The upper end of the piston rod 102 is formed having a reduced diameter portion, thereby defining an annular shoulder 103. A collar 105 is disposed about the upper end of the piston rod 102. The collar 105 includes a central aperture 106 having an inner diameter which is approximately equal to the outer diameter of the upper reduced diameter portion of the piston rod 102. Thus, the collar 105 can be seated on the shoulder 103 which is formed about the piston rod 102. A flexible protective boot 107 is provided about the piston rod 102 between the collar 105 and the upper end of the air cylinder 101. The flexible boot 107 prevents dirt and other contaminants from reaching the outer surface of the piston rod 102, yet permits the selective axial movement of the piston rod 102 described above.

The collar 105 supports a metallic electrical collar contact 110, a metallic electrical sleeve contact 111, and an annular bumper pad 112 about the piston rod 102 for axial movement therewith. The collar contact 110 is annular in shape and is disposed adjacent to the piston rod 102 about its reduced diameter portion. The sleeve contact 111 is also annular in shape and is disposed about the collar contact 110 in telescoping fashion. A pair of non-conductive, flexible O-rings 113 are received in respective annular recesses formed in the collar contact 110 to normally maintain the inner cylindrical surface of the sleeve contact 111 in spaced apart relationship from the outer cylindrical surface of the collar contact 110. The collar contact 110 is connected through a terminal 115 to a first electrical conductor 116. The sleeve contact 111 is connected through a terminal 117 to a second electrical conductor 118. The bumper pad 112 is also annular in shape and is disposed about sleeve contact 111. An upper end cap 120 is carried by the bumper pad 112 for protectively covering the terminals 115 and 117 and the conductors 116 and 118. The first and second conductors 116 and 118 extend downwardly through a longitudinal bore 121 formed through the piston rod 102 and the passageway formed through the carriage assembly 40 to a computer 122 illustrated in FIG. 1.

The collar contact 110 and the sleeve contact 111 form the two contacts of a single pole, single throw electrical switch. As shown in FIG. 7, the sleeve contact 111 is normally maintained out of engagement with the collar contact 110. In this position, the electrical switch is open, and no electrical current can flow through the first and second conductors 116 and 118. When the piston rod 102 is moved to the extended position, the side of the bumper pad 112 may be engaged by an edge of the planar glass workpiece which is moved in a plane which is generally perpendicular to the direction of the axial movement of the piston rod 102. The force of such engagement causes the bumper pad 112 to be moved radially inwardly toward the piston rod 102, thereby compressing the O-rings 113. As a result, the sleeve contact 111 is moved radially inwardly until the inner cylindrical surface thereof engages the outer cylindrical surface of the collar contact 110. This engagement of the sleeve contact 111 and the collar contact 110 closes the electrical switch, thereby permitting an electrical current to flow through the first and second conductors 116 and 118. When the edge of the glass workpiece is moved out of engagement with the bumper pad 112, the bumper pad 112 and O-rings 113 return to their original positions, thereby moving the sleeve contact 111 out of engagement with the collar contact 110 and opening the electrical switch.

Each of the locator button assemblies 100 is constructed in a similar manner, thereby providing a plurality of electrical switches which are adapted to be actuated by engagement with different points on the outer peripheral edge of the planar glass workpiece. The opening and closing of the electrical switches provide a sensing means for the computer 122 to determine when the glass workpiece is properly positioned within the grinding apparatus before beginning the grinding operation. Such proper positioning occurs only when all of the electrical switches have been closed (i.e., when all of the bumper pads 112 have be engaged by the outer peripheral edge of the workpiece). Thus, the computer 122 will not initiate the grinding operation until this condition has occurred. If the computer 122 senses that this conditions has not occurred at the expected time, it can recycle through the workpiece positioning procedure described in detail below, or it can generate an alarm signakl to an operator, indicating that a problem has occurred which requires attention.

The locator button assemblies 100 described above are particularly well suited for accomplishing the positioning of the planar glass workpiece in the glass grinding apparatus 10 of the present invention. Since the shape of the glass workpiece will vary from job to job, the angular disposition of the carriage assemblies 40 and the radial disposition of the locator cylinder assemblies 45 will vary. Thus, the points at which the outer peripheral edge of the glass workpiece will engage the peripheries of the bumper pads 112 will vary as well. Since the collar contacts 110, the sleeve contacts 111, and the bumper pads 112 are all annular in shape, it does not matter where the peripheries thereof are engaged by the outer peripheral edge of the glass workpiece. The electrical switches will be closed in the manner described above at any point about the circumference of the locator button assemblies 100.

The sequence of operation of the glass grinding apparatus 10 will now be explained in detail. Prior to utilizing the glass grinding apparatus 10, data is stored in the computer 122 which relates to the desired angular positions of the carriage assemblies 40 relative to the lower pan 15, as well as to the desired radial positions of the locator cylinder assemblies 45 relative to their associated carriage assemblies 40. Such angular and radial positions are dependent upon the particular size and shape of the glass workpiece which is to be ground. Having the above described positioning data at its disposal, the computer 122 initially energizes the second servo motors 74 of the motor assemblies 42. As a result, the carriage assemblies 40 are pivoted about the drive shaft 21 until they reach the predetermined desired angular positions relative to the lower pan 15. During this angular positioning step, the locator cylinder assemblies 45 are all retracted to their radially outermost positions on the carriage assemblies 40. As the proper angular positioning of each of the carriage assemblies 40 is achieved, the computer 122 de-energizes the associated second servo motor 74 to maintain such angular position. When the proper angular positioning of all of the carriage assemblies 40 have been achieved, the computer 122 energizes the first servo motors 54 of the motor assemblies 42. As a result, the locator cylinder assemblies 45 are moved radially inwardly toward the drive shaft 21 and the supporting platform 20 until they reach the predetermined radial positions relative to the supporting platform 20. As the proper radial positioning of each of the locator cylinder assemblies 45 is achieved, the computer 122 de-energizes the associated first servo motor 54 to maintain such radial position. In this manner, the locator button assemblies 100 are accurately moved about the lower pan 15 to respective predetermined locations. These predetermined locations define points which correspond to certain points along the outer peripheral edge of the workpiece. Thus, when those points on the outer peripheral edge of the workpiece are moved to the corresponding predetermined locations defined by abutment with the locator button assemblies 100, the workpiece is properly positioned within the glass grinding apparatus 10 to begin the grinding operation.

Figure 8:
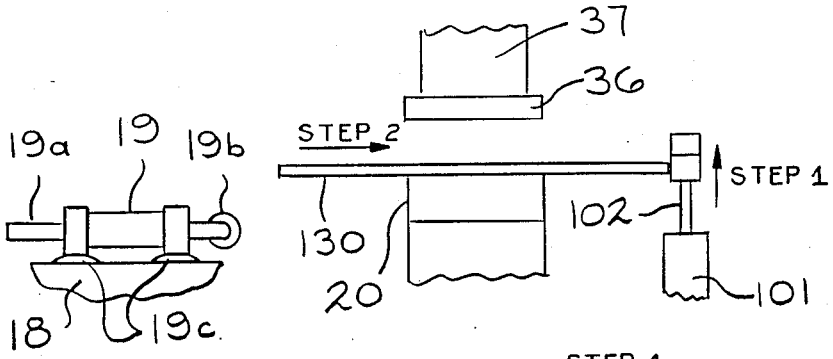
FIGS. 8, 9 and 10 are schematic fragmentary elevational views illustrating the sequential movements of one of the locator button assemblies and one of the vacuum locator assemblies illustrated in FIG. 1.
Figure 10:
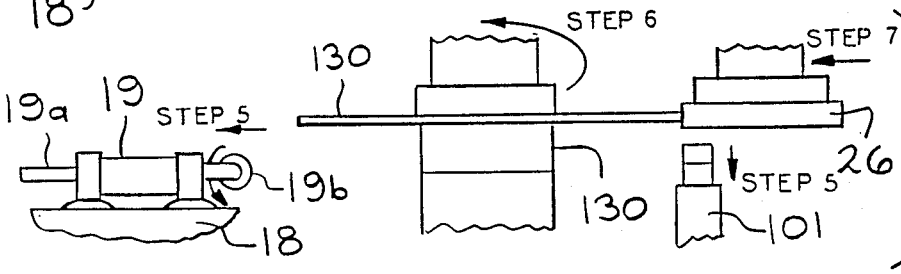

Referring now to FIGS. 8, 9, and 10, the schematic diagrams illustrate the sequence of operation of the glass grinding apparatus 10 which follows the above described initial positioning process. As shown therein, the computer 122 causes air pressure to be removed from the air cylinders 101 of the locator button assemblies 100 when they are all properly positioned. As a result, all of the piston rods 102 are extended upwardly. This is illustrated as Step 1 in FIG. 8. Next, a planar glass workpiece 130 is moved into the glass grinding apparatus 10 and laid upon the supporting platform 20. This is illustrated as Step 2 in FIG. 1. As the workpiece 130 is so inserted, it is generally not moved into abutting engagement with the bumper pads 112 carried on the extended piston rods 102. Consequently, the stationary relocators 19 are activated by the computer 122 to cause such engagement. Each of the stationary relocators 19 includes an L-shaped arm 19*a*, one leg of which is axially movable through the body of the relocator 19. The other leg of each of the L-shaped arms 19*a* has an annular bumper 19*b* secured thereto. The stationary relocators 19 are conventional in the art and are generally actuated by a source of vacuum (not shown). A valve (not shown) is disposed within each of the stationary relocators 19 for selectively connecting the arms 19*a* to the source of vacuum. A pair of suction cups 19*c* may be provided on each of the stationary relocators 19. The suction cups 19*c* may be continuously connected to the vacuum source so as to secure the stationary relocators 19 to the upper surface 18*a* of the upper pan. The actuation of the valves is controlled by the computer 122. When the valves are so actuated, vacuum causes the L-shaped arms 19*a* to rotate ninety degrees (such that the bumpers 19*b* are raised upwardly from the upper surface 18*a* of the upper pan 18) and to move inwardly toward the supporting platform 20. Consequently, the bumpers 19*b* engage the outer peripheral edge of the workpiece 130 and urge the workpiece into contact with each of the locator button assemblies 100. This is illustrated as Step 3 in FIG. 9.

As previously discussed, each of the locator button assemblies 100 generates a signal to the computer 122 when the edge of the workpiece 130 is in abutting engagement therewith. When the computer 122 senses that all of such signals are being generated, the workpiece 130 is properly positioned within the glass grinding apparatus 10, and the edge grinding operation may begin. The computer 122 next energizes the compressed air actuator 39, causing the clamping assembly 35 to move the clamp shaft 37 downwardly until the clamp member 36 engages the glass workpiece 130. This is illustrated as Step 4 in FIG. 9. As a result, the workpiece 130 is frictionally gripped by the clamp member 36 and the supporting platform 20. The computer 122 then causes the locator button assemblies 100 and the stationary relocators 19 to move to their retracted positions. This is illustrated as Step 5 in FIG. 10. Such retraction permits the workpiece 130 to be rotated about the vertical axis defined by the clamp member 36 and the supporting platform 20 without touching the bumper pads 112 or the bumpers 19*b*.

Following this retraction step, the computer 122 energizes the motor disposed within the base 11 to rotate the drive shaft 21, the supporting platform 20, the workpiece 130, and the clamp member 36 about the vertical axis. This is illustrated as Step 6 in FIG. 10. At the same time, the computer 122 energizes the servo motor 33 on the grinding spindle assembly 25 such that the grinding wheel 26 is moved into engagement with the outer peripheral edge of the workpiece 130. This is illustrated as Step 7 in FIG. 10. As the workpiece 130 is rotated, the grinding wheel 26 is continuously repositioned relative thereto. Such repositioning is based upon the desired final shape for the workpiece 130 following the grinding operation. Given the dimensional data stored in the computer 122, every point on outer peripheral edge of the workpiece can be defined as a specific radial distance from the center of the supporting platform 20. The computer 122 controls the movement of the grinding spindle assembly 25 such that the grinding wheel 26 is positioned at the specific distance from the center of the supporting platform 20, based upon the angular deposition thereof.

The grinding operation continues until the workpiece 130 has been rotated through one complete revolution. Thus, the grinding wheel 26 has engaged and ground the entire outer peripheral edge of the workpiece 130. Following this, the compressed air actuator 39 is activated by the computer 122 to raise the clamp shaft 37 and the clamp member 36 upwardly relative to the supporting platform 20. The clamp member 36 may include a suction cup 36*a* (FIG. 8) connected to the vacuum source. Thus, when the clamp member 36 is raised, the workpiece 130 is pulled upwardly with it off of the supporting platform 20. As the workpiece 130 is raised, the locator button assemblies 100 are moved back to their extended positions by the computer 122. From the raised position, the workpiece 130 can be removed from the glass grinding apparatus 10 by pulling it laterally away from the clamp member 36. At the same time, another workpiece can be inserted within the glass grinding apparatus 10 by laying it upon the supporting platform 20 in a manner similar to that described above. By raising the workpiece 130 with the clamp shaft 36, it can be seen that the speed of the change over operation from one workpiece to the next may be expedited.

In accordance with the provisions of the patent statutes, the principle and mode of operation of the present invention have been explained and illustrated in its preferred embodiment. However, it must be understood that the present invention may be practiced otherwise than as specifically explained and illustrated without departing from its spirit or scope.

What is claimed is:

1. An apparatus for supporting and positioning a workpiece having an edge within an apparatus comprising:

a lower pan defining an axis;

means for supporting the workpiece above said pan;

at least one carriage assembly connected for pivotal movement about said axis relative to said pan;

means for selectively pivoting said carriage assembly about said axis;

locator cylinder assembly means carried on said carriage assembly and movable relative thereto, said locator cylinder assembly including means for engaging the edge of the workpiece;

means for selectively moving said locator cylinder assembly relative to said carriage assembly; and means for pivoting said carriage assembly to a predetermined position relative to said pan and for moving said locator cylinder assembly to a predetermined position relative to said carriage assembly, whereby the workpiece may be positioned within the apparatus by laying the workpiece on said means for supporting and for moving the workpiece thereon until the edge thereof engages said means for engaging.

2. The invention defined in claim 1 wherein said means for pivoting said carriage assembly includes gear means formed on said lower pan and a motor assembly provided on said carriage assembly cooperating with said gear means.

3. The invention defined in claim 2 wherein said motor assembly includes servo motor means having a rotatable output shaft, said servo motor means adapted to be selectively energized to pivot said carriage assembly about said axis.

4. The invention defined in claim 3 wherein said motor assembly further includes gear means connected to said servo motor means output shaft for rotation therewith, said motor assembly gear means cooperating with said lower pan gear means such that energization of said servo motor means causes said carriage assembly to pivot about said axis.

5. The invention defined in claim 4 wherein said servo motor means is bi-directional, permitting said carriage assembly to be selectively pivoted in clockwise and counter-clockwise directions.

6. The invention defined in claim 4 wherein said motor assembly further includes a frame having bearing means connected thereto, said bearing means slidably engaging said lower pan for supporting said motor assembly and said carriage assembly for pivotal movement relative to said lower pan.

7. The invention defined in claim 6 wherein said motor assembly gear means is carried on a bracket pivotably mounted on said motor assembly frame to permit said motor assembly gear means to be selectively pivoted out of cooperation with said lower pan gear means.

8. The invention defined in claim 1 wherein said means for selectively moving said locator cylinder assembly means includes a motor assembly provided on said carriage assembly.

9. The invention defined in claim 8 wherein said motor assembly includes servo motor means having a rotatable output shaft, said servo motor means adapted to be selectively energized to move said locator cylinder assembly relative to said carriage assembly.

10. The invention defined in claim 9 wherein said motor assembly further includes a locator shaft connected to said output shaft for rotation therewith, said locator shaft having a worm gear formed on the exterior surface thereof.

11. The invention defined in claim 10 wherein said locator cylinder assembly further includes a ball nut cooperating with said locator shaft worm gear such that rotation of said locator shaft causes linear movement of said locator cylinder assembly therealong.

12. The invention defined in claim 1 wherein said servo motor means is bi-directional, permitting said locator cylinder assembly to be moved in two linear directions along said carriage assembly.

13. An apparatus for supporting and positioning a planar glass workpiece having an outer peripheral edge within a glass grinding apparatus comprising:

a generally circular lower pan defining a central axis therethrough;

means for supporting the workpiece above said lower pan;

a plurality of carriage assemblies each connected for pivotal movement about said axis relative to said lower pan;

means for selectively pivoting said carriage assemblies about said axis;

locator cylinder assembly means carried on each of said carriage assemblies and movable relative thereto, each of said locator cylinder assemblies including means for engaging the edge of the workpiece;

means for selectively moving each of said locator cylinder assemblies relative to its associated carriage assembly; and means for pivoting each of said carriage assemblies to a predetermined position relative to said lower pan and for moving each of said locator cylinder assemblies to a predetermined position relative to its associated carriage assembly, whereby the workpiece may be positioned within the apparatus by laying the workpiece on said means for supporting and for moving the workpiece thereon until the edge thereof engages all of said means for engaging.

14. The invention defined in claim 13 wherein said means for pivoting said carriage assemblies includes gear means formed on said lower pan and a motor assembly provided on each of said carriage assemblies cooperating with said gear means.

15. The invention defined in claim 14 wherein said means for supporting the workpiece includes a drive shaft extending upwardly through said lower pan along said central axis, each of said carriage assemblies being connected to said drive shaft for rotation thereabout.

16. The invention defined in claim 14 wherein each of said motor assemblies includes servo motor means having a rotatable output shaft, each of said servo motor means adapted to be selectively energized to pivot its associated carriage assembly about said central axis.

17. The invention defined in claim 16 wherein each of said motor assemblies further includes gear means connected to said servo motor means output shaft for rotation therewith, each of said motor assembly gear means cooperating with said lower pan gear means such that energization of each of said servo motor means causes its associated carriage assembly to pivot about said central axis.

18. The invention defined in claim 17 wherein each of said servo motor means is bi-directional, permitting its associated carriage assembly to be selectively pivoted in clockwise and counter-clockwise directions.

19. The invention defined in claim 17 wherein each of said motor assemblies includes a frame having bearing means connected thereto, each of said bearing means slidably engaging said lower pan for supporting its associated motor assembly and carriage assembly for pivotal movement relative to said lower pan.

20. The invention defined in claim 19 wherein each of said motor assembly gear means is carried on a bracket pivotably mounted on its associated motor assembly frame to permit said motor assembly gear means to be selectively pivoted out of cooperation with said lower pan gear means.

21. The invention defined in claim 13 wherein each of said means for selectively moving said locator cylinder assembly means includes a motor assembly provided on its associated carriage assembly.

22. The invention defined in claim 21 wherein each of said motor assemblies includes servo motor means having a rotatable output shaft, each of said said servo motor means adapted to be selectively energized to move its associated locator cylinder assembly relative to its associated carriage assembly.

23. The invention defined in claim 22 wherein each of said motor assemblies further includes a locator shaft connected to its associated output shaft for rotation therewith, each of said locator shafts having a worm gear formed on the exterior surface thereof.

24. The invention defined in claim 23 wherein each of said locator cylinder assemblies further includes a ball nut cooperating with its associated locator shaft worm gear such that rotation of said locator shaft causes linear movement of its associated locator cylinder assembly therealong.

25. The invention defined in claim 24 wherein each of said servo motor means is bi-directional, permitting its associated locator cylinder assembly to be moved in two linear directions along its associated carriage assembly.

* * * * *